US005293926A

United States Patent [19]

Love et al.

[11] Patent Number: 5,293,926

[45] Date of Patent: Mar. 15, 1994

[54] METHOD AND APPARATUS FOR DIRECT CASTING OF CONTINUOUS METAL STRIP

[75] Inventors: David B. Love, Natrona Heights; John D. Nauman, Pittsburgh, both of Pa.; Karl Schwaha, Linz, Austria

[73] Assignee: Allegheny Ludlum Corporation, Pittsburgh, Pa.

[21] Appl. No.: 876,885

[22] Filed: Apr. 30, 1992

[51] Int. Cl.[5] ..... B22D 11/06

[52] U.S. Cl. ..... 164/479; 164/429

[58] Field of Search ..... 164/463, 423, 479, 429

[56] References Cited

U.S. PATENT DOCUMENTS

| | | | |
|---|---|---|---|
| 4,678,719 | 7/1987 | Johns et al. | 428/594 |
| 4,715,428 | 12/1987 | Johns et al. | 164/463 |
| 5,045,124 | 9/1991 | Suehiro et al. | 148/2 |

FOREIGN PATENT DOCUMENTS

| | | | |
|---|---|---|---|
| 63-183755 | 7/1988 | Japan | 164/479 |
| WO89/07025 | 8/1989 | PCT Int'l Appl. . | |
| WO89/09667 | 10/1989 | PCT Int'l Appl. . | |
| WO90/10515 | 9/1990 | PCT Int'l Appl. . | |

*Primary Examiner*—Kuang Y. Lin

*Attorney, Agent, or Firm*—Patrick J. Viccaro

[57] ABSTRACT

A method and apparatus are provided for direct casting molten metal to continuous strip of crystalline material by controlling the supply of molten metal to a casting vessel substantially horizontal to an adjacent moving casting roll surface, the molten metal level in the exit end being near the crest of the casting roll, separating a semi-solid cast strip substantially horizontally from near the crest of the casting roll and providing secondary cooling while transporting the separated strip to solidify the strip.

16 Claims, 1 Drawing Sheet

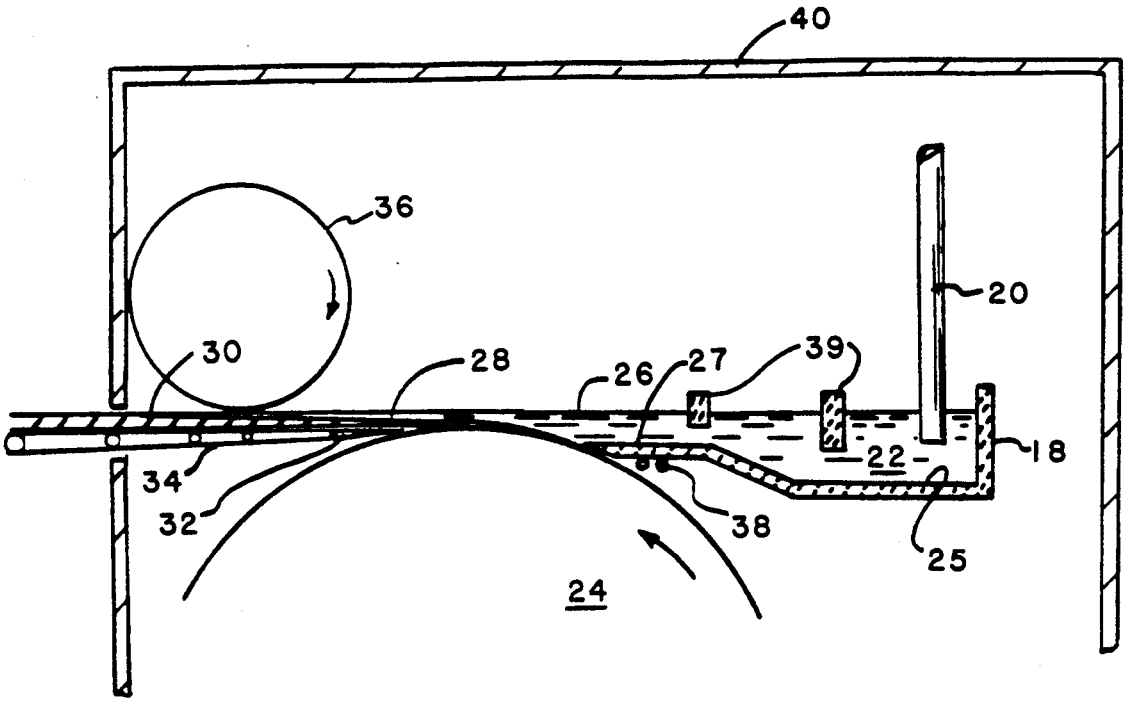
40
36
20
30
28
26
27
39
18
22
34
32
38
25
24

METHOD AND APPARATUS FOR DIRECT CASTING OF CONTINUOUS METAL STRIP

BACKGROUND OF THE INVENTION

This invention relates to a method and apparatus for direct casting of metal alloys from molten metal to continuous sheet or strip product. More particularly, it relates to feeding molten metal from an exit end of a casting vessel near the top of a casting roll surface to form a continuous strip of desired thickness.

In conventional production of metal strip, such methods may include the steps of casting the molten metal into an ingot or billet or slab form, then typically includes one or more stages of hot rolling and cold rolling, as well as pickling and annealing at any of various stages of the process in order to produce the desired final strip thickness and quality. The cost of producing continuous strip, particularly in as-cast gauges ranging from 0.010 inch to 0.160 inch (0.025 to 0.40 cm) could be reduced by eliminating some of the processing steps of conventional methods. The as-cast strip could be processed conventionally, by cold rolling, pickling, and annealing to various final gauges as thin as foil, for example 0.001 to 0.12 inch (0.025 to 0.30 cm).

There is a wide variety of methods and apparatus known for the production of directly cast strip. Typically such methods are those which include spraying molten metal through a metering orifice across a gap to a rapidly moving quenching surface, such as a wheel or continuous belt; methods which partially submerge a rotating quenching surface into a pool of molten metal; methods which use horizontal link belts as quenching substrates upon which molten metal flows for solidification; and methods of vertically casting with twin casting rolls having a pool of molten metal therebetween. Direct casting of metals through an orifice has long been attempted for commercial production of strip with good quality and structure, but with little success for crystalline metal strip.

More recently, other direct casting processes have been proposed but not developed into commercial processes. For example, a process is proposed for producing cold-rolled strip or sheet of austenitic stainless steel by using a continuous caster in which a casting-mold wall is moved synchronously with the cast strip and thereafter skin pass rolling as disclosed in U.S. Pat. No. 5,045,124, issued Sep. 3, 1991. Another process is disclosed in an International Application bearing No. PCT/US88/04641, filed Dec. 29, 1988 and published Aug. 10, 1989, using a melt drag metal strip casting system wherein molten metal is delivered from a casting vessel to a single chill surface such that the strip has an unsolidified top surface which is contacted by a top roll spaced a distance substantially equal to the thickness of the strip and having a temperature which will not solidify the top surface of the metal being cast. A specific tundish having flow diverters is disclosed in an International Application No. PCT/US88/04643, filed the same date and published Oct. 19, 1989. That same process and apparatus is also disclosed in another International Application No. PCT/US90/01211, filed Mar. 14, 1990 and published Sep. 20, 1990, but further describing a grooved chill surface.

Another method is provided for directly casting molten metal from the exit end of a casting vessel onto a moving casting surface to form a continuous strip of crystalline metal using the surface tension of the molten metal for forming the top, edge, and bottom surfaces of the strip being cast with good surface quality, edges and structure. An apparatus is also provided including a casting vessel having a molten metal receiving end and an exit end from which a fully-developed uniform flow of molten metal leaves through a U-shaped structure to a moving casting surface. U.S. Pat. No. 4,678,719, issued Jul. 7, 1987, solves many problems associated with the prior art direct casting methods and apparatus such as those described above. U.S. Pat. No. 4,715,428, issued Dec. 29, 1987, describes a related method of radiantly cooling the molten metal at the exit end of the vessel.

What is still needed is a method and apparatus useful in the commercial production for direct casting strip having surface quality comparable to or better than conventionally-produced strip. Such a method and apparatus should be able to produce sheet and strip product having uniform thickness and flatness and having a smooth upper and lower surface with no porosity in the sheet. Furthermore, the method and apparatus should minimize or eliminate any handling damage of the strip after separation from the casting surface and be suitable for casting continuous strip in gauges ranging from 0.010 to 0.160 inch (0.025 to 0.40 cm). The direct cast strip should have good surface quality, edges and structure and properties at least as good as conventionally-cast strip and be suitable for the casting of carbon steels and stainless steels.

SUMMARY OF THE INVENTION

In accordance with the present invention, a method is provided for directly casting molten metal to continuous strip of crystalline material. The method includes controlling the supply of molten metal to a casting vessel which feeds a substantially uniform flow and temperature of molten metal having a free upper surface from an exit end of the vessel substantially horizontally to an adjacent casting surface. The casting surface moves generally upwardly past the exit end of the vessel and the casting surface includes a single surface of a cylindrical roll which rotates about its longitudinal axis aligned substantially horizontally to provide primary cooling for molten metal solidification. The exit end of the casting vessel is placed adjacent the casting roll such that the molten metal level in the exit end of the vessel is near the crest of the casting roll. The method includes separating the cast strip substantially horizontally from near the crest of the casting roll surface while the strip is semi-solid having an unsolidified upper surface and then providing secondary cooling of the continuously-cast strip on the transporting means after removing the strip from the casting surface to solidify the strip.

An apparatus is also provided for directly casting molten metal to continuous strip of crystalline material comprising a movable casting surface, a casting vessel, means for controlling the supply of molten metal to the casting vessel, means for separating the cast strip in semi-solid form from the casting roll, and means for transporting the removed semi-solid strip for completing solidification of the strip. The casting surface includes a single surface of a cylindrical roll rotatable about its longitudinal axis aligned substantially horizontally to provide primary cooling of the molten metal. The casting vessel exit end is about as wide as the strip to be cast and is placed in close proximity adjacent the casting surface such that the molten metal level in the exit is near the crest of the casting roll surface. The apparatus includes a means for maintaining substantially uniform flow and temperature of molten metal at the exit end. A means for separating the cast strip in semi-solid form substantially horizontally is provided near the crest of the casting roll as well as a means for providing secondary cooling of the removed strip to complete solidification. Means for transporting the strip substantially horizontally from the separator during completion of solidification of the strip is also provided.

BRIEF DESCRIPTION OF THE DRAWING

The FIGURE is a schematic of a strip casting apparatus of the present invention.

DETAILED DESCRIPTION OF THE PREFERRED EMBODIMENTS

The FIGURE generally illustrates a casting vessel 18 for directly casting molten metal on a casting surface 24 to produce continuous product in strip or sheet form 30. Molten metal 22 is supplied from a vessel (not shown) to casting vessel 18 through a nozzle 20, preferably a submerged entry nozzle (SEN). Stopper rods or slide gate mechanisms (not shown) or other suitable means may control the flow of molten metal to casting vessel 18 such as through spout or nozzle 20. Casting vessel 18 is shown substantially horizontal, having a receiving end and an exit end disposed in close proximity adjacent to the casting surface 24.

The supply of molten metal 22 to the casting vessel 18 may be accomplished by any suitable conventional methods and apparatus of vessels, tundishes, or molten metal pumps, for example.

Casting surface 24 may be a single casting wheel or one of twin casting wheels or rolls. The composition of the casting surface may be critical to the metal strip being cast, however, it does not form a part of the present invention, although some surfaces may provide better results than others. The method and apparatus of the present invention have been used successfully with casting surfaces of copper, carbon steel, and stainless steel. The casting surface includes a single surface of a cylindrical roll rotating about its longitudinal axis aligned substantially horizontally.

It is important that the casting surface be movable past the casting vessel at controlled speeds and be able to provide desired quenching rates to extract sufficient heat to initiate primary solidification of the molten metal into strip form. The casting surface 24 is movable past casting vessel 18 at speeds which may range from 20 to 500 feet per minute (6 to 152.4 meters/minute), preferably 50 to 300 feet per minute (15.2 to 91.4 meters/minute), which is suitable for commercial production of crystalline metals. The actual casting speed plays an important role in the strip thickness and must be balanced with other factors of the present invention. The casting surface 24 should be sufficiently cooled in order to provide a quenching of the molten metal to extract heat from the molten metal to begin solidification of the strip into crystalline form. The quench rates provided by casting surface 24 are less than 10,000° C. per second, and typically less than 2,000° C. per second. Such local cooling rates have been estimated from dendrite arm measurements in the cast strip microstructure. Although cooling rates change through the strip thickness, an overall or average cooling rate may be on the order of 2000° C./second or less.

One important aspect of the casting surface is that it have a direction of movement generally upwardly past the exit end of casting vessel 18 and a free surface in the molten metal pool in the exit end. The free surface of the molten metal pool in the exit end is necessary to develop good top surface quality of the cast strip. By "free", it is meant that the top or upper surface of molten metal is unconfined by structure, i.e., not in contact with vessel structure, rolls or the like and free to seek its own level at the exit end of the casting vessel 18.

Another important feature is that casting vessel 18 is located adjacent the casting roll 24 such that the inside bottom surface 27 of casting vessel 18 is substantially horizontal and below the crest of the casting roll. By so-locating the casting vessel in close proximity adjacent that position in the upper quadrant of the casting wheel, the free surface of the molten metal bath in the exit end of casting vessel 18 is near the crest of the casting wheel. By near it is meant that the bath level in the exit end of vessel 18 can be slightly below, slightly above, or at the crest of the casting roll. This has been found to be essential for providing uniform thickness, soundness, freedom from porosity, and flatness, as well as smooth upper surface, of the continuously-cast strip product.

Casting vessel 18 may take various shapes, however, the exit end should be generally U-shaped, having a bottom, two (2) sides and a width which approximates the width of the strip to be cast. Casting vessel 18 may include dams, weirs or baffles 39, as shown in FIG. 1, to dampen and baffle the flow of molten metal 22 in order to facilitate a uniform fully-developed flow in the exit end of casting vessel 18. Preferably, the exit end of vessel 18 is relatively shallow compared to the entry end 25 of vessel 18. It has been found that a relatively deep entry end 25 facilitates a smooth substantially uniform flow of molten metal over inside surface 27 and onto the casting surface. As is described in U.S. Pat. No. 4,678,719, the molten metal in the exit end has a top surface tension and the molten metal leaving the vessel has edge surface tension which form, in part, the top and edges, respectively, of the cast strip 28. The bottom surface is formed from surface tension in the form of a meniscus between the bottom inside surface of the generally U-shaped structure and the casting surface 24.

An important feature of the invention includes a substantially uniform temperature of the molten metal in the exit end of the vessel 18. Temperature uniformity can be achieved through proper preheating and insulating together with uniform flow development. In the alternative, a means for heating 38 may be provided, such as heating elements and the like in the exit end of vessel 18.

Another feature of the method and apparatus of the present invention is the separation of the cast strip substantially horizontally from near the crest or crown of the casting roll surface 24 while the strip 28 is substantially semi-solid, i.e., having an unsolidified upper surface. As shown in FIG. 1, a separator means 32 is placed near the crest of the casting roll 24 substantially horizontally as the casting surface moves generally upwardly past the exit end of casting vessel 18. Such a separator 32 may take conventional forms, such as a blade or air jet stripper, so as to facilitate removal of the strip from the casting surface and to minimize contact time with the casting wheel. It is important that most or all of the separator means 32 be substantially horizontal in order to minimize handling damage of the strip upon separation since it is in semi-solid form, i.e., having a non-solid upper surface with initial solidification of the bottom surface due to the contact with the casting wheel. It has been found that if the separator means were not substantially horizontal, then there is a tendency for the non-solid upper surface of the semi-solid cast strip to flow at a speed different from the overall strip speed. For example, a downward separation may result in the non-solid upper surface flowing faster downwardly than the strip speed. This condition may result in adequate but certainly poorer upper surface quality of the strip upon complete solidification. An upward separation may result in a similar poor quality for the opposite reasons.

It has been found that the strip separation should occur within 20 degrees from the crest of the casting roll, preferably within 15 degrees, and more preferably 10 to 15 degrees from the crest. Furthermore, the separation preferably is done on the downstream side of the crest of the casting roll. Handling of the semi-solid strip in accordance with the present invention avoids severe damage to the strip product due to the inherent tensile weakness of the semi-solid strip. The horizontal separation minimizes gravitational pull which would otherwise cause the strip to fall apart under its own weight as it would move downwardly from the crest or crown of the casting wheel.

In combination with separation of the semi-solid cast strip from a casting surface, preferably, the method provides substantially horizontally transporting the semi-solid strip. Solidification is completed after removal from the casting surface 24 and during transporting over the separator means 32 and the transporting means 34. Typically, the transporting means 34 is aligned with or integral with the separator means 32. A general requirement of transporting means 34 is that it exerts little or no friction on the cast strip being transported. Ideally, there would be no net forces on the semi-solid strip in the plane of the strip during solidification. In practice, slight amounts of tension or compression are likely used in handling of the strip on transporter means 34. The amount of force, if any, has not been able to be measured. While the present invention contemplates substantially no net forces on the semi-solid cast strip, slight or minor amounts of tension or compression may be used depending on the alloy composition being cast. When preferably transporting the semi-solid strip substantially horizontally with little or no friction, a solid strip with good upper surface quality is produced.

In the alternative, synchronization of downstream pinch rolls (not shown) on solidified strip would be sufficient to avoid upstream tearing or breakage of the semi-solid strip due to gravitational forces if the strip is moving downwardly.

A means is also provided for secondary cooling of the continuously-cast semi-solid strip after removing it from the casting surface. In one embodiment, the semi-solid strip is cooled by a suitable gaseous atmosphere above the molten metal in the exit end of vessel 18, above the separator means 32 and above the transporting means 34. The atmosphere may be inert, reducing, or oxidizing, as desired.

In another embodiment radiant cooling may be used above the non-solid upper strip surface to facilitate heat extraction. Such radiant cooling, using a panel of cooling tubes (not shown) could be used in combination with the gaseous atmosphere.

In another embodiment secondary cooling may be provided by contacting the upper non-solid surface of removed semi-solid strip with a rotating roll 36 above the strip. Preferably roll 36 would be as wide as the cast strip. Added advantages of such a roll 36 is to help provide a smooth upper surface of the solidified strip and as an aid to control overall thickness and edge-to-edge thickness of the strip. It is contemplated that any one or more of the secondary cooling means can be used in combination.

The method and apparatus of the present invention may also include a means for maintaining an atmosphere, temperature, and composition at the exit end of the casting vessel adjacent the casting surface to control solidification. Particularly, the apparatus may comprise a housing means 40 within which includes the movable casting surface 24, casting vessel 18, and means for supplying molten metal to the casting vessel, such as nozzle 20. The main purpose of such a housing is for control of the atmosphere and temperatures surrounding the molten metal 22 in casting vessel 18, as well as the unsolidified top surface of the cast strip 28. Depending on the alloys or metals being cast, it may be desirable to provide inert atmospheres, such as an argon atmosphere, in the vicinity of the molten metal. Furthermore, through adequate insulation or cooling of housing 40, the temperature of the atmosphere could affect the overall heat extraction and solidification of strip 30. The housing may also be located in the vicinity of molten metal surfaces to control oxidation and solidification, for example.

Although there is no intent to be bound by theory, it appears that the solidification of the molten metal leaving the exit end of casting vessel 18 commences with the molten metal contacting the casting surface 24 as it leaves the bottom of the generally U-shaped opening of the exit end of casting wheel 18. The casting surface provides primary cooling of the lower portion, or bottom portion, of the molten metal available to the casting surface at the exit end of casting vessel 18. The thickness of the strip is formed by adjusting and controlling the level of molten metal 22 leaving the exit end of casting vessel 18. Such a pool of molten metal is believed to form part of the strip thickness with a portion of the strip thickness resulting from molten metal solidified against the casting surface 24. Casting speed and depth of the pool of metal together are important to determine the residence time of the metal on the casting surface and the resulting strip thickness. Greater thickness can be achieved by raising the molten metal level at the exit end of the vessel 18 or slowing the casting speed. Depending on the thickness of strip being cast, the amount of strip thickness being solidified on the casting surface, and being solidified after separation will vary. For thinner strip, such as less than 0.050 inch (0.127 cm), it is believed that the non-solid upper surface of semi-solid strip may not exceed 30% of the total strip thickness. For thicker strip, the non-solid upper surface is likely to be higher, maybe as high as 50% of total strip thickness. The practical limit of non-solid percentage of thickness appears to be dependent upon the capabilities of the handling systems, such as separator means 32 and transporting means 34 and the alloy and molten temperatures associated with the strip being cast.

It appears that the combination of casting speed, casting adjacent the wheel, maintaining the free surface of molten metal level near the crest of the wheel, substantially horizontally removing the semi-solid strip from near the crest of the wheel, and substantially horizontally transporting the strip contributes to the uniform thickness and flatness of the strip produced, as well as good surface quality and overall thickness. The controlled residence time of the cast strip on the casting wheel provides for a more uniform overall cooling of the strip throughout its thickness while providing an initial solidification of the lower strip surface in order to give the molten metal some structural integrity as a strip shape.

Although the method of the present invention is believed to work for casting roll surfaces of various sizes, it has been found that a casting wheel of relatively small diameter works well when used with the other features of the present invention. Such a small casting wheel may have a diameter on the order of less than 24 inches. Such a small diameter wheel, when used in combination with other features of the present invention, results in a controlled but minimum residence time of the cast strip on the wheel. There are practical reasons to control the residence time on the casting surface. Shorter residence times minimize bottom surface quality problems of the strip caused by entrapped gases and other causes, for example. The use of as small a wheel as possible also has practical advantages. For example, the cast strip is easier to separate from the casting surface because of the tangential angles. The exit end of vessel 18 can be more easily form fit to the shape of the casting surface. Furthermore, differential thermal expansions of the casting surface and vessel are minimized.

What is claimed is:

1. A method of directly casting molten metal to continuous strip of crystalline metal comprising:

controlling the supply of molten metal to a casting vessel for feeding molten metal of substantially uniform flow and temperature and having a free upper surface from an exit end of the vessel substantially horizontally to an adjacent noncontacting casting surface;

moving the casting surface generally upwardly past the exit end, the casting surface includes a single surface of a cylindrical roll rotating about its longitudinal axis aligned substantially horizontally to provide primary cooling for molten metal solidification;

providing the vessel adjacent the casting roll and maintaining the molten metal level in the exit end of the vessel near the crest of the casting roll and maintaining surface tension of the top, bottom, and sides of the molten metal exiting the vessel;

separating the cast strip substantially horizontally from near the crest of the casting roll surface while the strip is semi-solid having a non-solid upper surface; and providing secondary cooling of the continuously cast strip to solidify the strip after removing it from the casting surface.

2. The method of claim 1 wherein separating the strip substantially horizontally within a range up to 20 degrees from the crest of the casting roll.

3. The method of claim 2 wherein separating the strip is within 15 degrees of the crest.

4. The method of claim 2 wherein separating the strip ranges from 10 to 15 degrees of the crest.

5. The method of claim 2 wherein separating occurs on the downstream side of the crest of the casting roll.

6. The method of claim 1 wherein the combined effect of primary and secondary cooling is an overall rate less than 2000 degrees centigrade per second.

7. The method of claim 1 wherein providing secondary cooling is in the form of gaseous atmosphere.

8. The method of claim 7 wherein the atmosphere is inert

9. The method of claim 1 wherein providing secondary cooling by contacting the upper surface of the separated strip with a rotating roll at least as wide as the cast strip.

10. The method of claim 1 includes substantially horizontally transporting the semi-solid cast strip after separation from the casting roll during completion of solidification.

11. The method of claim 1 includes transporting the semi-solid cast strip with substantially no net forces in the plane of the strip.

12. The method of claim I wherein transporting the semi-solid cast strip with only minor tension forces in the plane of the strip.

13. The method of claim 1 wherein transporting the semi-solid cast strip with only minor compression forces in the plane of the strip.

14. The method of claim 1 includes heating the exit end of the casting vessel for purposes of maintaining substantially uniform temperature of the molten metal above its liquidus temperature.

15. The method of claim 1 includes maintaining the temperature and composition of the atmosphere at the exit end of the vessel adjacent the casting roll to control solidification.

16. A method of directly casting molten metal to continuous strip of crystalline metal comprising:

controlling the supply of molten metal to a casting vessel for feeding molten metal of substantially uniform flow and temperature and having a free upper surface from an exit end of the vessel substantially horizontally to an adjacent noncontacting casting surface;

rotating a cylindrical casting roll about its longitudinal axis aligned horizontally to provide primary cooling for initial solidification of the molten metal;

providing the vessel adjacent the moving casting roll surface;

maintaining the molten metal level in the exit end of the vessel near the crest of the casting roll such that surface tension of the molten metal forms the top, bottom, and sides of the strip being cast;

separating the cast strip substantially horizontally within 20 degrees from the crest of the casting roll, which strip is semi-solid having a non-solid upper surface;

substantially horizontally transporting the semi-solid cast strip from the casting roll with either no net forces or only minor tension or compression forces in the plane of the strip during further solidification; and providing secondary cooling of the cast strip to complete solidification after separation from the casting roll.

* * * * *